United States Patent [19]

Maier

[11] 4,068,783

[45] Jan. 17, 1978

[54] SKIRT MARKER AND SHAPING DEVICE

[75] Inventor: Erwin Maier, Kongen, Germany

[73] Assignee: Wilhelm Maier & Sohne UNITAS-Maschinenfabrik, Kongen, Germany

[21] Appl. No.: 718,377

[22] Filed: Aug. 27, 1976

[30] Foreign Application Priority Data

Aug. 30, 1975 Germany ..... 2538751

[51] Int. Cl.[2] ..... A41H 9/00

[52] U.S. Cl. ..... 223/1.1; 112/178; 33/9 R

[58] Field of Search ..... 33/9 R, 10, 2 H, 9 A; 112/178, 176, 112.15, 112.25, 252; 223/1.1, 57, 68, 70

[56] References Cited

U.S. PATENT DOCUMENTS 3,713,408 1/1973 Cox et al. ..... 112/121.15

3,722,441 3/1973 Rumball et al. ..... 112/121.15 X

*Primary Examiner*—G. V. Larkin

[57] ABSTRACT

A pressure plate is mounted on a vertical support for holding material. A material deflector is pivotally mounted with respect to the support and is adapted to deflect the material against the pressure plate. The pressure plate and the material deflector are formed with cooperating opposed faces for folding the material and with a needle guide for passage of a needle through the folds. A needle to which thread is fed, is held on a carrier and is movably mounted on the support to carry the needle into and out of the needle guide. A clamping device is arranged at the rear end of the needle guide to grasp the thread, and a cutter means is located at the front end of the needle guide to cut the thread. All of the elements are sequentially operated by a single actuator.

28 Claims, 13 Drawing Figures

SKIRT MARKER AND SHAPING DEVICE

BACKGROUND OF THE INVENTION

The present invention relates to apparatus for marking and shaping the hem of a skirt, coat, dress or the like, with inserted lengths of thread.

A skirt shaping and marking device by which such a tacking seam is made, is described in DT-OS No. 1,610,797, wherein the material to be marked is held between a pressure plate and a material deflector by means of a lever which can be swung by hand. The lever is held in this working position with one hand, while the thread is manually pulled using a separate needle, by the other hand through a needle guide in the pressure plate and the material deflector. The end of the thread is secured by means of a clamping device in the form of a slide, while the working position of the lever is maintained. After securing the end of the thread, the thread is moved manually against a fixed cutting blade at the end of the needle pulled through the needle guide and the thread pulled through the folds of the material is cut off. The material held between the pressure plate and the material deflector is then released again by resetting the slide and lever.

The operation and handling of this well known skirt shaping and marking device is very difficult. Particularly when inserting and cutting off the thread, special care must be taken to ensure than the cut piece of thread is retained securely in the material and that the thread is not pulled out of the needle.

It is the purpose of the invention to improve on the known type of skirt shaping and marking device in such a way that a simple and easily performed operation allows all processes to be performed automatically, while it is ensured that a piece of thread is inserted into the material, cut off and held therein securely in every operating procedure.

SUMMARY OF THE INVENTION

In accordance with the invention, this is achieved by holding the needle in an adjustable position on a carrier which is movable together with the lever actuating the pressure plate. The thread is fed to the needle from a thread spool, the needle carrying out a stitching and a withdrawing operation through the needle guide simultaneously with the clamping and releasing of the material between the pressure plate and the material deflector. The thread securing device is located at the end of the needle guide and takes the formed thread loop at the start of the needle withdrawing operation so that it holds the loop and releases it again at the end of the withdrawing movement. A thread cutting device is located at the beginning of the needle guide and can be brought back to its starting position outside the needle guide on the return of the needle. When using this arrangement and with control of the needle, the thread securing device and the thread cutting device, the thread may be inserted, secured, cut and released after a pre-set run for each operation of the actuating device, ensuring that after the operation the piece of thread is inserted safely into the material and is held by the material when the pressure plate and the material deflector release the material again.

By adjustment of the skirt shaping device relative to the material and by repeated operation of the actuating device, it is possible to apply very quickly a tacking seam characterised by inserted pieces of thread.

Introduction of the thread into the needle guide between the pressure plate and the material deflector is facilitated by forming the needle as a swivelling curved needle such as the curved needles of this type, known especially for blind stitch sewing machines.

The thread can be held in the material which has been perforated because the pressure plate and material deflector produce vertical folds in the material held and because the curved needle can be swivelled in a horizontal plane, which is approximately at right angles to the held materia. However, it may also be provided that the pressure plate and the material deflector produce vertical folds in the held material and that the curved needle may be swivelled in a vertical plane approximately parallel to the held material. In both cases, the thread is introduced with a loop on the outside of the material and is fixed to the material at both ends.

One embodiment of the invention provides for the inserted thread to be held during the withdrawing operation of the needle by the use of a clamping jaw as a thread clamping device. The clamping jaw may be spring-loaded and supported by a clamp stop, and can be lifted off and released from the clamp stop via a control cam of control mechanism on the actuating device. Details of the control of the thread clamping device are as follows: The control part is in the form of a plate which can be swivelled together with the carrier carrying the curved needle, and the clamping jaw in the form of a bolt is guided in a slot in the plate so that it can be lifted off via an attachment protruding into the slot. The attachment holds the end flange of the bolt from below. The plate at the same time covers the carrier and the curved needle, thus permitting the curved needle to penetrate the material effectively only where it is clamped between the pressure plate and the material deflector.

Another embodiment ensures that the stitching and withdrawing movement of the curved needle is not impeded by arranging the clamping stop at one side of the needle guide and the bolt adjustably guided on the opposite side of the needle guide. Moreover, the thread loop formed during the withdrawing motion of the curved needle is thereby gripped securely and held in this embodiment.

The problem of cutting off the inserted thread is solved by forming the cutting device as the fixed cutting plate and a swivelling cutting blade. This cutting blade is adjustable from the control plate which plate can be swivelled with the curved needle in the direction of the fixed cutting plate via an actuating attachment. The stitching and withdrawing motions are not affected by this thread cutting device, if provision is made for the control plate to be adjusted via the actuating attachment only when the curved needle is in the starting position, while the control plate releases the actuating attachment of the cutting blade during the stitching and withdrawing movements of the curved needle, in such a way that the cutting blade can be lifted off the fixed cutting plate by means of a re-setting spring. The cutting plate and the cutting blade, re-set by means of a re-setting spring, are located on opposite sides of the thread guide and release the needle guide.

The various movements to be derived may be obtained by virtue of the following factors: the actuating device is fitted with a vertically aligned actuating shaft, which can be turned around its own axis in the support; the needle carrier and the control plate are joined together rigidly with this actuating shaft; the material deflector is fixed to the support within the swivelling range of the curved needle; the pressure plate is attached to a swivelling lever which is rotatably carried by the support and can be swivelled towards the material deflector by means of a control cam; this control cam is positively joined to the actuating shaft and the swivelling lever can be lifted off and material deflector, when released by the control cam, by means of a re-setting spring. Thus, all functions necessary for the automatic insertion of a piece of thread into the material can be carried out by one simple turning movement.

A skirt shaping device with a vertically directed actuating motion, which can be operated much more easily, can be constructed by having the actuating device fitted with a control rod which can be adjusted vertically in the support; by having the material deflector fixed to the support; by having the pressure plate, the curved needle with the needle carrier, the thread clamping device and the thread cutting device arranged at the end of a swivelling lever, which, when actuated by the control rod via a control lever, can be first deflected in the direction of the material deflector; by having the control lever drive a driving rod, which swivels the needle carrier when the control rod continues its actuating motion; and by allowing the carrier rod and the control rod to be re-set by means of their own re-setting springs. The actuating motion can be easily pre-set by limiting the actuating motion of the control rod by means of two guide rings which make contact with the support in both end positions of the control rod, one of them serving at the same time as a stop for the re-setting spring. The problem of controlling the swivelling lever via the control lever is solved by having the control lever supported by a stop on an extension of the swivelling lever which protrudes beyond the swivelling axis of this lever, and by having the contact part of the control lever shifting the swivelling lever into a position of contact with the material deflector in the starting range of the actuating motion through a bevel on the tilting lever extension.

The actuating motion of the control rod is converted into a swivelling motion of the needle carrier by supporting the needle carrier in a rotating bearing in the swivelling lever and by guiding the driving rod connected with the needle carrier by means of a carrier on the control lever. In order that this swivelling motion of the needle carrier is not introduced until the swivelling lever reaches its working position and holds the material, the driving rod is held in the starting position by the re-setting spring and that the end stop of the driving rod is set at a distance from the carrier on the control lever.

The swivelling lever is controlled by the control lever by providing for the swivelling lever to be held in contact with the corresponding contact part of the control lever by means of a tension spring.

A tacking seam can be adjusted to different heights measured from floor lever because the support is divided into a beam and a supporting structure, and the supporting structure is adjustable and attachable to the vertical beam.

Different material thicknesses in the area between the pressure plate and the material deflector can be accomodated due to the material deflector being adjustably fixed to the supporting structure and/or by providing an adjustable stop for the material deflector in the area of the pressure plate.

Feeding of the thread to the curved needle is obtained in an improved manner by fitting to the supporting structure a mandrel for receiving the thread reel and eyes to guide the thread between reel and curved needle.

The arrangement of the thread clamping device and thread cutting device is such that the cutting plate and the clamping stop are fitted to the supporting structure or the swivelling lever, and the cutting blade can be swivelled around these and that the clamping bolt is adjustably supported or guided in them.

The tacking seam with the inserted pieces of thread is also secured safely in a skirt, coat or the like provided with a hem, if provision is made for the curved needle to be mounted in such a way that the material held between the pressure plate and the material deflector is perforated from the inside. After applying the tacking seam, the hem can be released and undone without the pieces of thread coming out of the material.

Full details of the invention are set forth in the following description and in more detail by drawings accompanying this disclosure.

DESCRIPTION OF THE INVENTION

Figure 1:
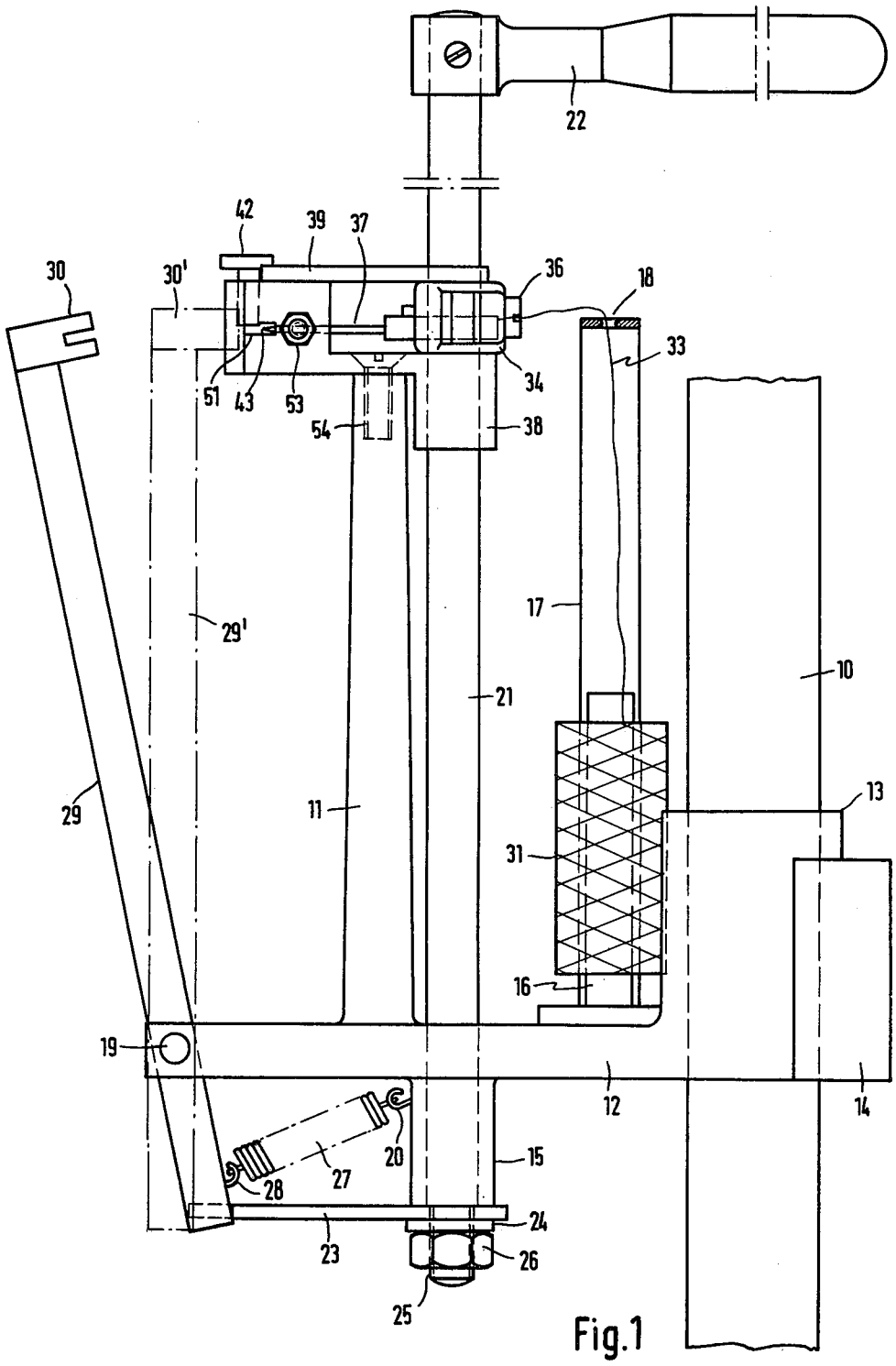
FIG. 1 is a side view of a skirt shaping device in accordance with the invention.
Figure 2:
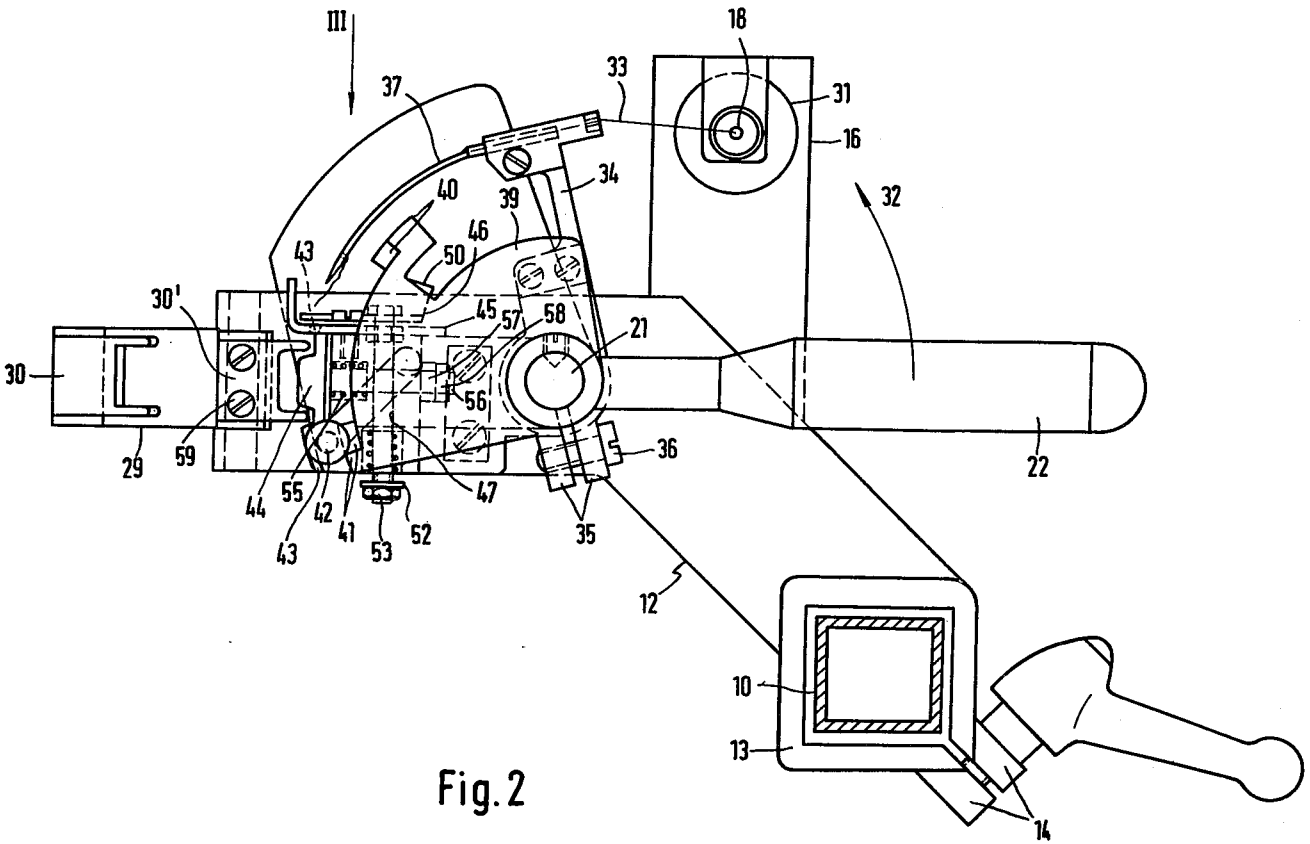
FIG. 2 is a plan view of the skirt shaping device shown in FIG. 1.
Figure 3:
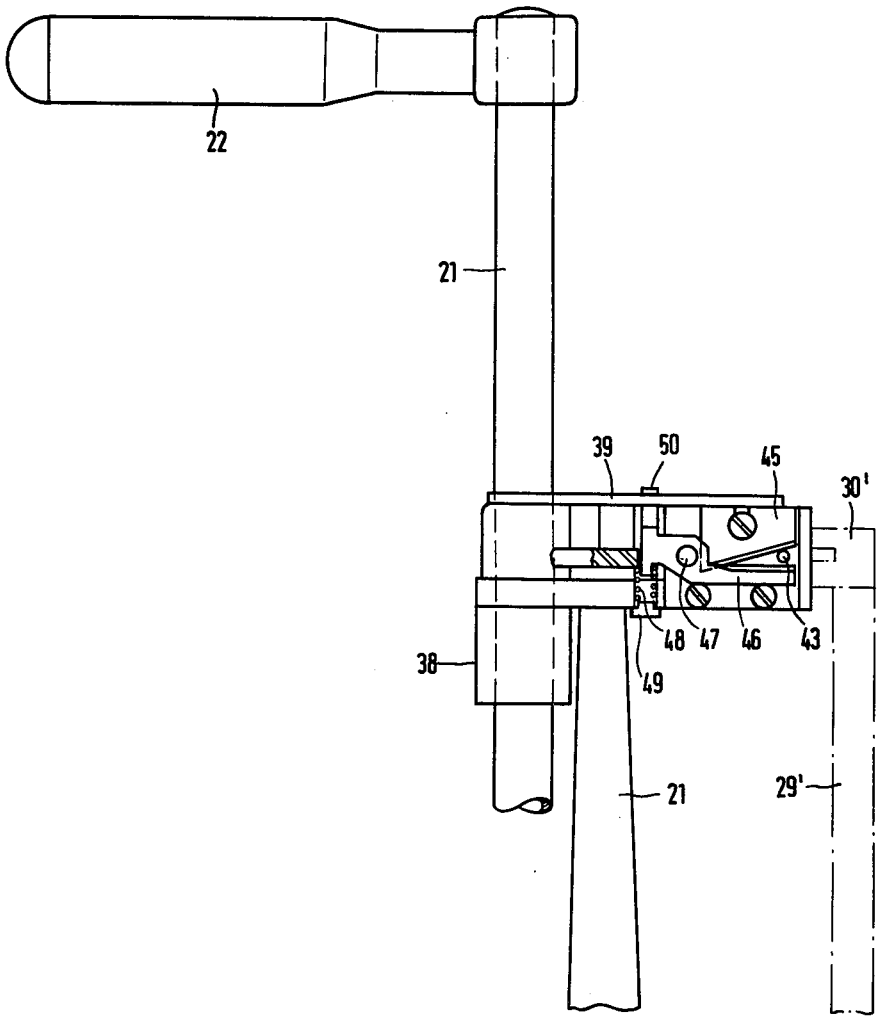
FIG. 3 is a partial view of FIG. 1 showing the thread cutting device taken in the direction of arrow III.

In the skirt shaping device according to FIGS. 1 to 3, a horizontal supporting bracket 12 is adjustably mounted on a vertical beam 10 secured to a base adapted to be placed on the floor or ground. The bracket 12 is held by a bifurcated clamping sleeve 13, the flanges 14 of which are held together by a fixing screw attached to a lever thus enabling the position of the supporting structure 12 on beam 10 to be fixed. The height of the tacking seam can be set in this manner. Extending vertically from the bracket 12 is a supporting arm 11 on which a material supporting member 38 is fixed. The supporting member is shaped in the form of a circular sector or wedge having an actuating shaft 21, rotatably guided through its central hub. The upper end of the actuating shaft 21 carries a handle 22, by which the shaft may be rotated about its vertical axis.

A needle carrier 34 having a curved needle 37 adjustably joined to the actuating shaft 21 extends over the supporting part 38, by a bifurcated clamping jaw 35 and locking screw 36. A material deflector 44 is held on the edge of the support member 38, and has a needle guide 43 through which the curved needle 37 passes. A cam plate 39 covers the needle carrier 34 and the curved needle 37 and is fixed to carrier 34 so that it can be swung jointly with the needle carrier 34. The material deflector 44 is provided with a shaft supported on the material support member 38 by a compression spring 55 which can be adjusted by screw 56 and the two nuts 57 and 58.

The thread 33 is unreeled from a thread reel 31 which is pushed onto a mandrel 16 which is joined to the supporting structure 12 generally parallel to the shaft 21. The needle 37 is held in a tubular bracket by a screw so as to be adjustable and reversible. The thread enters the end of the tubular bracket and is attached to the needle. Between thread reel 31 and curved needle 37, the thread 33 is guided through an eye 18 which is fitted to the end of bracket 17.

The material support member 38 is fixed to support arm 11 by means of screw 54. In addition to the central hub, the actuating shaft 21 is held as well in a bearing sleeve 15 extending from the bottom of the supporting bracket 12. A threaded end section 25 of the actuating shaft 21 protrudes from bearing sleeve 15 and has fixed to it a control cam 23, using a washer 24 and nut 26 for this assembly.

The control cam 23 is engaged by the extension of a swingable lever 29 which is pivotally supported by a bearing bolt 19 on the supporting bracket 12. A tension spring 27, which is suspended between hooks 20 and 28 on the swivelling lever 29 and bearing sleeve 15 respectively, normally biases the lever 29 in contact with the control cam 23. This control cam 23 is shaped in such a way that on rotation of the actuating shaft 21 it swings conjointly and shifts the lever 29 into position 29' very quickly so that a pressure plate 30 fixed to its free upper end, by screws 59, makes contact with the face of the material deflector 44 in the contact position 30'. The arrangement is made so that this swivelling motion is carried out before the curved needle 37 passes the start of the needle guide 43. The material is thus clamped between pressure plate 30 and material deflector 44 and is laid into one or several vertical folds depending on the design of the pressure plate and material deflector. The material deflector 44 extending into the path of curved needle 37 is also fitted with a needle guide 43, which is simply provided in the form of a slot in its face.

The rotary movement of actuating shaft 21 in the direction of arrow 32 is limited in such a way that the curved needle 37 extends beyond the end of the needle guide 43 in the end stitch position. During the opposite backward rotation of the actuating shaft 21, the curved needle 37 is carried out of the needle guide with the withdrawing motion and is re-set to its initial position illustrated in FIG. 2.

A cutting plate 45 is fixed at the front edge of the needle guide 43 on the supporting structure 38, in such a way that it is located on one side (front) of the needle guide 43, as can be clearly seen from FIG. 3. In addition, a cutting blade 46 is supported so that it can rotate on supporting structure 38, about a pivot bolt 47 and can be adjusted via a spring 48 adjustable by screw 49, washer 52 and nut 53 so that the cutting blade 46 is pressed against cutting plate 45 with a selected higher or lower pressure. The cutting blade 46 is equipped with an actuating cam attachment 50 which engages the underside of the cover plate 39 in the initial position. The cover plate 39 is cut out, as seen in FIG. 1, so that it depresses the actuation cam attachment 50 only in this initial position, but allows the blade to be swivelled against the spring 48 around swivelling bolt 47 when the needle moves forward to the stitch position. The blade 46 is closed in order to cut off a thread located in the needle guide 43, only when the curved needle 37 returns to its initial position outside the needle guide 43 at the end of the withdrawing motion. If the actuating shaft 21 is again rotated, cutting blade 46 — overcoming the tension of spring 48 — is swivelled away from the area of the needle guide by the disengagement of control plate 39 and actuating attachment 50, so that the curved needle 37 is in a position to carry out the stitching motion into needle guide 43.

At the end of the needle guide 43, the supporting bracket 38 forms a clamping stop 51 below the needle guide, which supports a spring-loaded clamping bolt 42, adjustably guided by the needle guide 39 which underpins the end flange of clamping bolt 42 by means of inclined flanges 40 and 41 spaced at each end of cover 39 which lifts it from clamping stop 51. The flanges 40 and 41 are arranged in such a way that the clamping bolt 42 is lifted off of the clamping stop 51 at the end point of the stitching motion which corresponds to the starting point of the withdrawing motion, and the end point of the withdrawing motion which corresponds to the starting point of the stitching motion. The thread securing device consisting of clamping bolt 42 and clamping stop 51 for this reason operates in such a way that it can take up the formed thread loop at the start of the withdrawing motion of curved needle 37, holding the thread loop during continuation of the withdrawing motion and releasing it at the end of the withdrawing motion. After the thread is cut off, the piece of thread pulled through the material is, therefore, completely released and remains securely held in the material. Pivotable lever 29 holding the material is released on the last part of the resetting motion of actuating shaft 21 via control cam 23. The resetting spring 27 lifts the pressure plate 30 together with the swivelling lever 29 from the material deflector 44. It is possible to re-adjust the material and reclamp it an any time between the stitching cycles.

A single stitching motion of the curved needle 37 is derived from each rotary movement in the direction 32 of handle 22 and the single withdrawing motion in the resetting action, secures, cuts and releases the thread in the preset sequence dictated by cover plate 39. All of the necessary motions for holding and releasing the material are derived from the movement of the lever 29 by the rotation of shaft 29 carrying out the control of pressure plate 30 and material deflector 44.

All control sequences required for inserting pieces of thread when producing a tacking seam with the skirt shaping device are thus carried out automatically by one actuating operation and in the present time sequence.

In the embodiment according to FIGS. 4 to 8, the curved needle 76 is supported so that it can be caused to move, not by the supporting structure 12 but by the lever 73; moreover, it can be swung in a vertical plane which is approximately parallel to the material 100 which is held between the pressure plate 30 and material deflector 44. The advantage of this design lies in the fact that material 100 can be perforated from the inside and that swinging lever 73 which holds the curved needle 76, the thread clamping device and the thread cutting device, can nevertheless be of low height. The operating mode of the thread clamping device and the thread cutting device is unchanged and is again determined by a cam cover plate 39 which, in this instance, is arranged vertically together with needle carrier 77. This needle carrier 77 is supported so that it can swing about a pivot bolt 75 on the lever 73.

The actuating device rather than a rotating shaft comprises a vertically movable control rod 60 which is guided in the supporting bracket 12. In addition, the material support member 38 fixed to the material support 11 carries out a guide operation for control rod 60. Fixed to this support member 38 (FIG. 8) is a guide 95 having ledges 96 between which the material deflector 44 can be adjustably seated. A fixing screw 93 functions to limit or stop the position of material deflector 44, both of whose fingers 97, separated by the needle guide, protrude from the support member 38.

The reciprocating actuating motion of the control rod 60 is limited by two adjusting rings 62 and 63 spaced to either side of supporting member 38. The adjusting ring 63 at the same time serves as a stop for a resetting spring 64 normally biasing the rod 60 upward. The upper end of control rod 60 carries a knob 61, while a control lever 65 is fixed to the lower end by means of washer 66 and nut 67 on a threaded end 68. The control lever 65 engages the extension 71 of the swinging lever 73 via contact ball 69 biased by a spring 70. The lever 73 is supported so that it can pivot about a bolt 72 journalled in the supporting bracket 12. The extension 71 is provided with an adjusting taper or is bent angularly and is pulled against the contact ball 69 by a tension spring 80 and is thus held in normal contact with the ball 69. The tension spring 80 is suspended on a pin 81 depending from the supporting bracket 12 and at the end of extension 71 at points 82 and 83, respectively.

Figure 4:
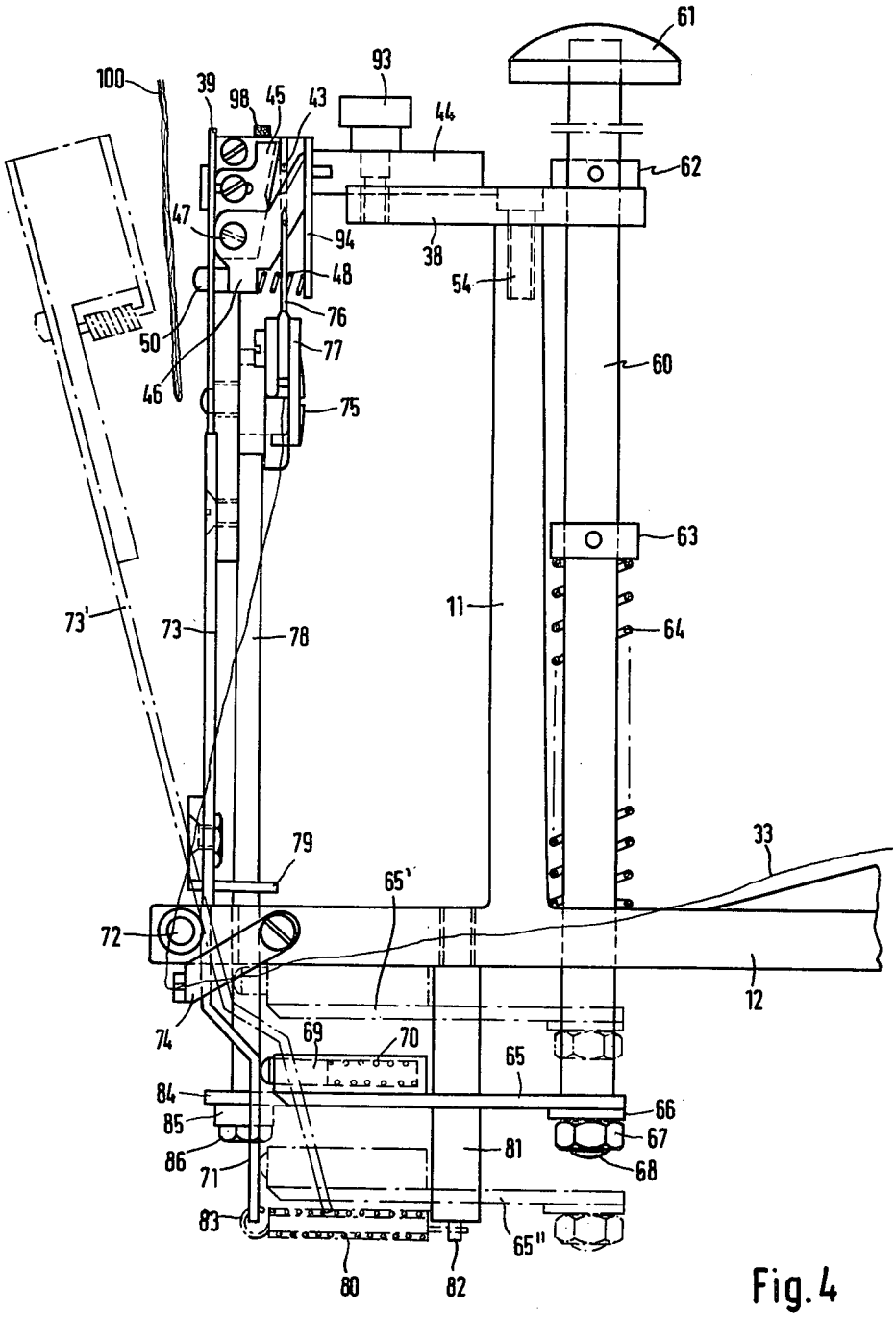
FIG. 4 is a side view of another skirt shaping device according to the present invention.

Attached to the end of control lever 65 is a lateral extending carrier plate. The plate 84 has a hole which serves as a guide arm for a driving rod 78, which is also movably supported in a guide eye 79 fixed to the swivelling lever 73. The upper end of the rod 78 is hinged to fork 88 which is fixed to bolt 75 rotatably journalled in the swinging lever 73, and to which is also fixed the needle carrier arm 77. A resetting spring 87 is supported between the guide eye 79 and fork 88 to normally bias the rod upward. The needle carrier 77 is fixed to the swivelling bolt 75 via clamping jaws 90 and clamping screw 91. The free lower end of the driving rod 78 forms a limit stop, comprising a nut 86 and spacing collar 85. When the control rod 60 is moved downwards, the contact ball 69 deflects the extension 71 of lever 73, so that the latter leaves its initial position 73' causing the pressure plate to make contact with the material deflector 44. This swinging action takes place when contact ball 69 is guided along the taper of extension 71. In addition, the carrier 84 is moved freely on the driving rod 78 and will only make contact with the limit stop 85, 86 of the rod. The initial position of the driving rod 78 is such that the latter is only moved by the control lever 65 after the lever 73 has already been swung inwardly so that, for example, the clamping bolt 42 of the thread clamping device contacts the control slot of cam plate 39. The spring 87 which is pushed on the driving rod 78 clamps the needle carrier 77 in that initial position. This intermediate position is shown in FIG. 4 as a solid line. When the control rod 60 is moved further downward, the carrier 84 will push the driving rod 78 downward. In doing so, the contact ball 69 slides along the extension 71, maintaining the position of swivelling lever 73. The lowermost position of the control rod 60 is determined by adjusting ring 62, the control lever 65 adopting the position 65''. The driving rod 78 which is thus carried along with the actuating rod 60 controls the stitching motion of curved needle 76 and the rotary motion of control plate 39.

When the control rod 60 is released, the resetting spring 64 will automatically return the control lever 65 into the initial upward position 65'. In doing so, the withdrawing motion of the curved needle 76 is executed because the resetting spring 87 maintains driving rod 78 in contact with carrier 84 of control lever 65. During the withdrawing motion, the bolt 42 and the cutting blade 46 are actuated in the manner illustrated in the embodiment shown in FIGS. 1 to 3.

In the last stage of the resetting motion, contact ball 69 releases the lever 73 allowing it to swing back into the initial position. In doing so, the driving rod 78 is no longer carried along by carrier plate 84 and stops in the position reached at the end of the withdrawing motion of the curved needle 76.

During the stitching and withdrawing motion of the curved needle 76, the thread 33 which is fed to the eye 74 of curved needle 76 is pulled through needle guide 43. The clamping bolt 42, which in this instance is movable horizontally, will take up the thread loop below the cam attachments 40 and 41, will hold it and release it again. The thread cutting device with fixed cutting plate 45 and swinging cutting blade 46 is again arranged at the end of the needle guide 43 and can be controlled by the cam plate 39 via an actuating lug 50.

The curved needle 76 and pressure plate, which can be swung conjointly with the pivoted lever 73, are covered by a plate 94 on the side facing the material deflector 44. This cover plate 94 permits the transition of the material deflector 44 to pressure plate 30 and is preferably attached hingedly to pivoted lever 73, in order to facilitate access to curved needle 76 when threading thread 33.

Figures 5, 6:
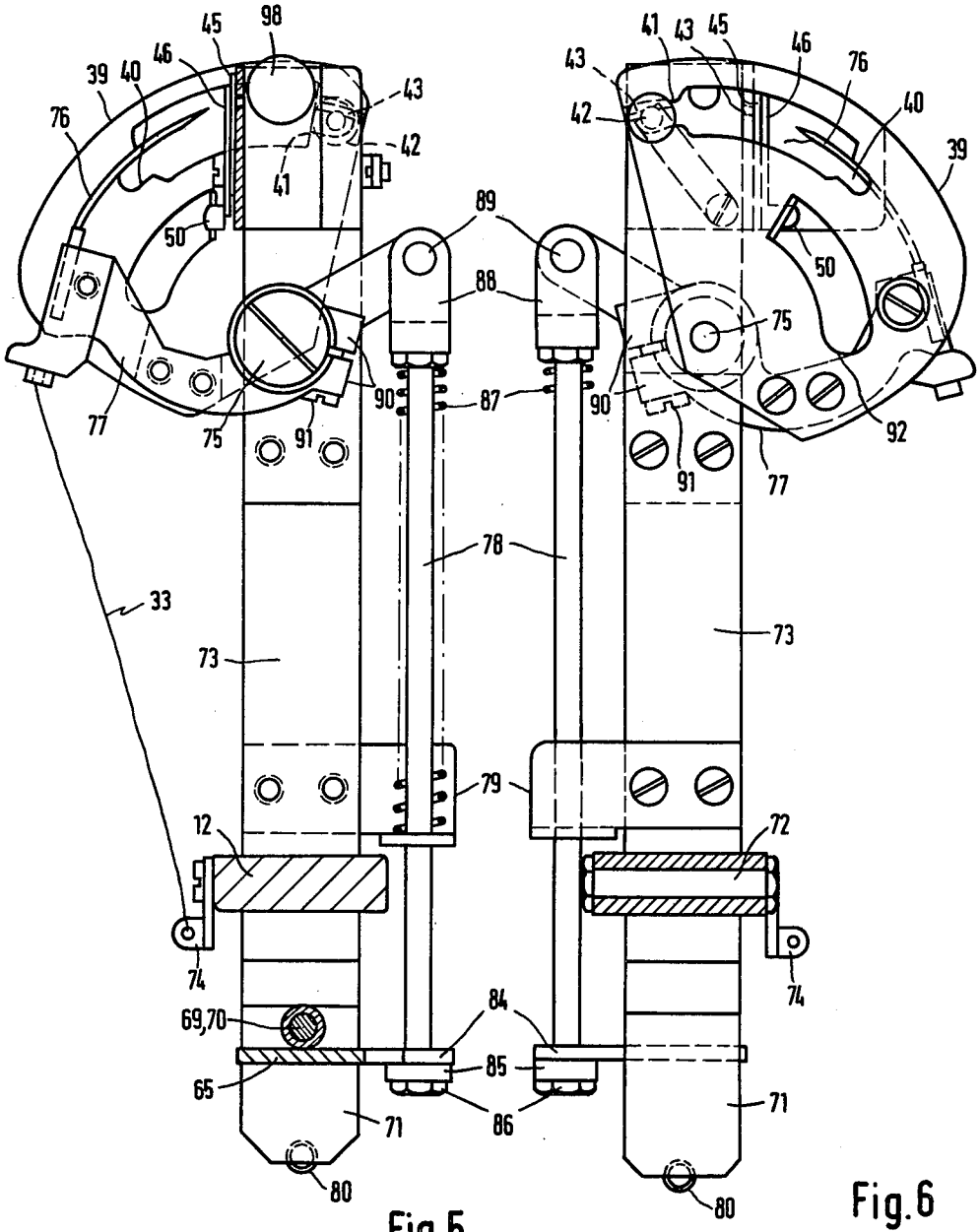
FIG. 5 is an exterior view of the swivelling lever of the device according to FIG. 4.
FIG. 6 is an interior view of the swivelling lever of FIG. 5.
Figure 7:
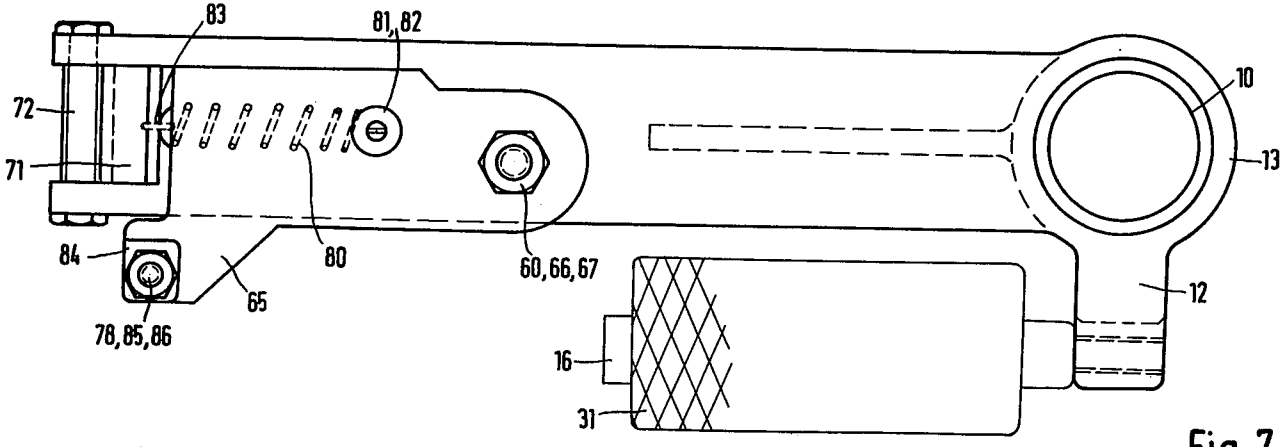
FIG. 7 is a bottom view of the device according to FIG. 4.
Figure 8:
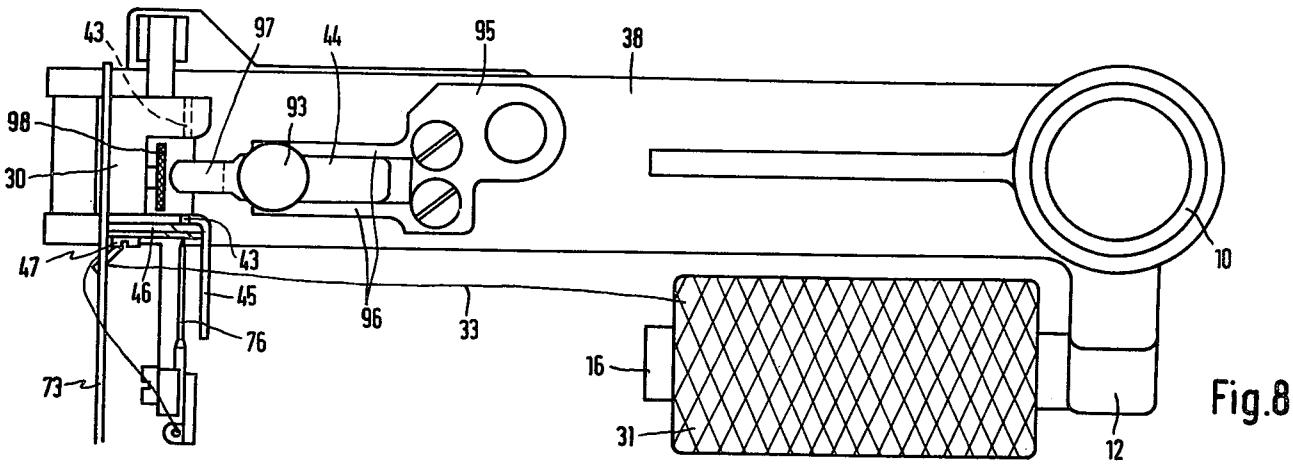
FIG. 8 is a top view of the device according to FIG. 4.

As can be seen especially from FIGS. 5 and 8, a stop 98 for the material deflector 44 is threadedly fixed within the range of pressure plate 30. By rotating stop 98, its threaded part is screwed into or out of pressure plate 30. It can thus be adapted and adjusted to various thicknesses of material.

For this purpose, it is also an advantage for the material deflector 44 to carry fingers 97 of different widths at its ends and to be able to be fixed to the guide part 95 in two diametrically opposite positions.

Moreover, in both the embodiments of FIGS. 1–3 and of FIGS. 5–8, the design for the pressure plate 30 and the material deflector 44 can be interchanged without impairing operation. Adaption of the two components must be carried out in such a way that one or more vertical folds are produced in the material 100, which are then perforated by curved needle 37 or 76 or in an approximately horizontal plane. An arrangement which permits the curved needle to penetrate the material on the inside is preferred. Reference to FIGS. 9–13 will illustrate this.

Figure 9:
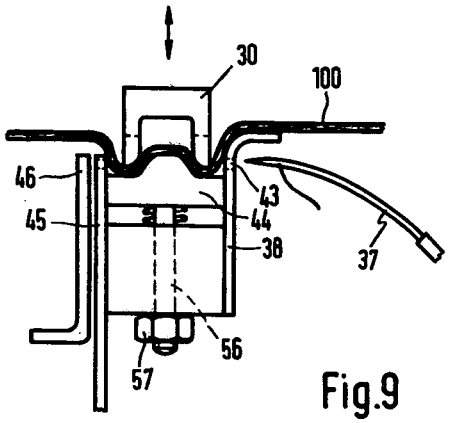
FIG. 9 is a partial view, showing diagrammatically the thread stitching for the device according to FIGS. 1 to 3.
Figure 10:
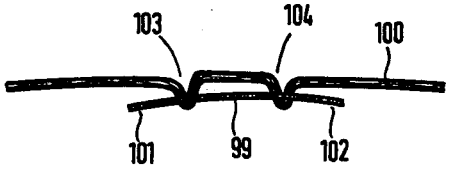
FIG. 10 is a view of a piece of thread inserted into the material in the device of FIG. 9.

As shown in FIG. 9, the pressure plate 30, swingable away from the inside of material 100, presses the material against the material deflector 44, which is adjustably attached to the supporting structure 38 via the spring-loaded set screw 56 and nut 57. As can be seen from FIG. 10, the material 100 is laid into two shallow vertical folds 103 and 104. The needle guide 43 which may be transversed slots or holes is formed in the material deflector 44 and the fingers of pressure plate 30 in such a way that the curved needle 37 penetrates both folds, as can be seen from FIG. 10. A thread loop 99 is formed between the two folds 103 and 104 on the outside of the material; the thread ends 101 and 102 fixed in folds 103 and 104 can also be seen on the outside of the material. It remains to be mentioned that the penetrations of folds 103 and 104 may be made only by stitching of the material with both one stitching and one withdrawing motion on the outside of the material.

Figure 13:
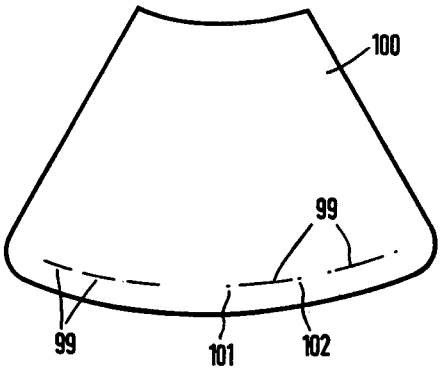
FIG. 13 shows a skirt provided with a tacking seam in accordance with the present invention.

The right-hand side of FIG. 13 illustrates the tacking seam produced in the lower hem area of the skirt by the skirt shaping device. The extended thread loops 99 and the thread ends 101 and 102 are directed horizontally and can be seen on the outside of the material of the skirt 100.

Figure 11:
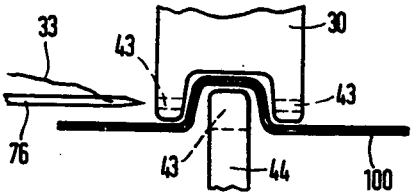
FIG. 11 is a partial view, which shows diagrammatically the thread stitching for the device according to FIGS. 4 to 8.

As shown diagrammatically in FIG. 11, the material deflector of the skirt shaping device in accordance with FIGS. 4 to 8 presses the material 100 against the pressure plate 30, forming a wide as well as a deep fold which is vertical to the plane of the drawing.

The curved needle 76 with thread 33 is swung therefor on the inside of the material 100 and is moved through needle guide 43 during the stitching and withdrawing motion, the needle guide being in the form of a hole in the pressure plate 30 and in the material deflector 44 in the form of a transverse slot in the face of the material deflector 44. On the right-hand side of the pressure plate 30, i.e., at the end of needle guide 43, the thread clamping device is arranged, while on the left-hand side of the pressure plate 30, i.e., at the start of the needle guide 43, the thread cutting device is arranged.

Figure 12:
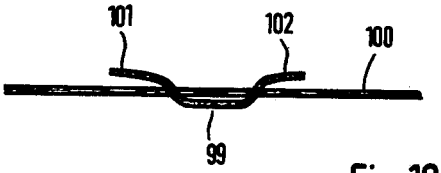
FIG. 12 is a view of a piece of thread inserted into the material in the device of FIG. 11.

In this way, the piece of thread with the loop 99 becomes visible on the outside of material 100 after the thread 33 has been cut and the material 100 released, while the two ends 101 and 102 of the piece of thread are guided through material 100 and are left in the inside of the material 100 as shown in FIG. 12.

If the material 100, for example, a skirt, a coat or the like, is in the hem area folded so as to have two layers, both layers of material are stitched and the pieces of thread are fixed in the same manner as if only one layer. If the folded hem is undone and let out, the pieces of thread continue to be held in the exterior layer of the material without change. The folded hem can be extracted without the pieces of thread and can be pulled away via the thread ends 101 and 102.

As shown on the left-hand side of FIG. 13, a horizontal tacking seam can be attached to the skirt-shaped material 100 by means of the new skirt shaping device in accordance with FIGS. 4 to 8, the seam being marked only by the thread loops 99 at the outside of the skirt. The pitch of the thread loops 99 is influenced by the step by step adjustment of the skirt shaping device relative to the skirt or the progressive rotation of the skirt, in the manner well known to tailors or housewives. The actuating shaft 21 or rod 60 of the skirt shaping device must be actuated once for each thread loop 99; the feeding of the thread, the fixing of the material between pressure plate and material deflector, stitching and withdrawing of the curved needle, control of the thread clamping device and thread cutting device and the release of the material in a time cycle pre-set for safe operation, is carried out fully automatically and all control movements are derived from the actuating device.

The present disclosure is intended to be illustrative only of the present invention. The disclosure is not to be taken as limiting the scope of the present invention.

What is claimed:

1. Apparatus for shaping and marking a skirt with inserted threads, comprising a vertical support, a pressure plate mounted on said support for holding said material, a material deflector pivotally mounted with respect to said support and adapted to deflect said material against said plate, said pressure plate and said material deflector being formed with cooperating opposed faces for folding said material and with a needle guide for passage of a needle through said folds, a needle, a needle carrier movably mounted on said support for movement carrying the needle into and out of said needle guide, means for feeding a thread to said needle, a clamping means arranged at the rear end of said needle guide to grasp said thread, cutting means located at the front end of said needle guide to cut said thread and actuating means for sequentially operating said material deflector, needle carrier, clamping means and cutting means to effect insert of thread of defined length in the folds of said material.

2. The apparatus according to claim 1, wherein said needle is removably and adjustably secured to said needle carrier.

3. The apparatus according to claim 2, wherein said needle is curved.

4. The apparatus according to claim 1, wherein the pressure plate and the material deflector produce vertical folds in the material and the needle is movable in a horizontal plane at approximately right angles to the material.

5. The apparatus according to claim 1, wherein the pressure plate and the material deflector produce vertical folds in the fixed material and the needle is movable in a vertical plane which is approximately parallel to the fixed material.

6. The apparatus according to claim 1, wherein the clamping means comprises a clamping stop and a spring-loaded jaw, said jaw engaging said clamping stop and includes a cam adapted to lift the jaw off the clamping stop and release the same in response to the movement of the actuating means.

7. The apparatus according to claim 6, wherein the actuating means comprises a plate which can be moved together with the needle carrier, and the clamping jaw comprises a bolt guided in a slot in the plate, said bolt being lifted by a flange, protruding into the slot, holding the head of the bolt from below.

8. The apparatus according to claim 7, wherein the plate covers the needle carrier and the needle.

9. The apparatus according to claim 8, wherein the stop is arranged below the needle guide and the bolt is movably guided on the opposite side of the needle guide.

10. The apparatus according to claim 9, wherein the cutting means comprises a fixed cutting plate and a pivotal cutting blade, said cutting blade being movable in the direction of the fixed cutting plate via an actuating lug from the plate.

11. The apparatus according to claim 10, wherein the plate moves the cutting blade via the actuating lug only in the starting position of the curved needle, while during the stitching and withdrawing motion of the curved needle the plate deactuates the cutting blade, so that the cutting blade can be lifted off the fixed cutting plate by means of a biasing spring.

12. The apparatus according to claim 11, wherein the cutting plate and the cutting blade are arranged on opposite sides of the needle guide spaced from the end thereof.

13. The apparatus according to claim 1, wherein the actuating device is provided with a vertically aligned actuating shaft which is arranged on said support to be rotated around its own longitudinal axis; the needle carrier and the plate being fixedly joined to said actuating shaft; and the material deflector is fixed to the support within the swivelling range of the needle; and includes a pivot lever pivotably supported on said support, said pressure plate being mounted on said pivot lever to be swivelled towards the material deflector; a control cam rotatably connected to said actuating shaft for actuating said pivot lever and a resetting spring for biasing said pivot lever away from the material deflector on release by said control cam.

14. The apparatus according to claim 1, wherein the actuating device is provided with a control rod vertically movable in the support, the material deflector, the material deflector is fixed to the support, and the pressure plate, the needle with the needle carrier, the thread clamping device and the thread cutting device are arranged at the end of said pivot lever, and includes a control lever for swinging said pivot lever initially in the direction of the material deflector when actuated by the control rod, a driving rod actuated by further motion of the control rod to swivel the needle carrier away, the driving rod and the control rod being provided with normally biasing resetting springs.

15. The apparatus according to claim 14, wherein the actuating movement of the control rod is limited by means of two adjusting rings which are in contact with the support in the two end positions of the control rod, one of them being used at the same time as a stop for the resetting spring.

16. The apparatus according to claim 14, wherein the control lever is supported by an extension of the pivot lever beyond pivoting shaft via a contact part, and wherein in the initial stages of the actuating motion the contact part of the control lever shifts the pivot lever into a position in contact with the material deflector via a taper on the extension of the pivot lever.

17. The apparatus according to claim 15, wherein the needle carrier is rotatably supported on the pivot lever and the control lever includes a carrier for supporting the driving rod which is joined to the needle carrier.

18. The apparatus according to claim 17, wherein the driving rod is held in the initial position by the resetting spring and the end stop of the driving rod is at a distance to the carrier of the control lever.

19. The apparatus according to claim 18, wherein the distance between the end stop of the driving rod and the carrier is selected in such a way that the actuating movement of the curved needle is not initiated until the pivot lever makes contact with the material deflector.

20. The apparatus according to claim 18, wherein the pivot lever is kept in contact with the contact part of the control lever by means of a tension spring.

21. The apparatus according to claim 13, wherein the support is subdivided into a vertical beam and a supporting structure, the supporting structure being adjustably fixed to the vertical beam.

22. The apparatus according to claim 13, wherein the material deflector is movably fixed to the supporting structure.

23. The apparatus according to claim 13, wherein a mandrel, threaded reel supported on said mandrel and eyes for guiding the thread between thread reel and curved needle are fitted to the supporting structure.

24. The apparatus according to claim 13, wherein the cutting plate and the clamping stop are attached to one of the supporting structure and pivot lever, the cutting blade being pivotably mounted on said clamping stop and the clamping bolt is adjustably supported therein.

25. The apparatus according to claim 24, wherein the pressure plate and the material deflector are interchangeably mounted on the pivoted lever and on the support.

26. The apparatus according to claim 25, wherein an adjustable stop for the material deflector is located adjacent the pressure plate.

27. The apparatus according to claim 1, wherein the needle and said needle guide are arranged in such a way that the material fixed between the pressure plate and material deflector is perforated from the inside.

28. The apparatus according to claim 1, wherein the needle and said needle guide are arranged in such a way that the material fixed between pressure plate and material deflector is perforated from the outside.

* * * * *